United States Patent [19]

Nakazawa et al.

[11] Patent Number: 4,717,459

[45] Date of Patent: Jan. 5, 1988

[54] ELECTROLYTIC GOLD PLATING SOLUTION

[75] Inventors: Masao Nakazawa; Yoshirou Nishiyama; Shinichi Wakabayashi, all of Nagano, Japan

[73] Assignee: Shinko Electric Industries Co., Ltd., Nagano, Japan

[21] Appl. No.: 845,522

[22] Filed: Mar. 28, 1986

[30] Foreign Application Priority Data

May 30, 1985 [JP] Japan ..... 60-115278
May 30, 1985 [JP] Japan ..... 60-115279
May 30, 1985 [JP] Japan ..... 60-115280

[51] Int. Cl.[4] ..... C25D 3/48; C25D 3/62
[52] U.S. Cl. ..... 204/44.3; 204/47.5
[58] Field of Search ..... 204/44.3, 47.5, 109, 204/123

[56] References Cited

U.S. PATENT DOCUMENTS

| | | | |
|---|---|---|---|
| 3,380,898 | 4/1968 | Danemark et al. | 204/44 |
| 3,787,463 | 1/1974 | Zuntini et al. | 204/47.5 X |
| 3,833,488 | 9/1974 | Bick et al. | 204/47.5 |
| 3,990,954 | 11/1976 | Foulke et al. | 204/47.5 |
| 4,062,736 | 12/1977 | Meyer et al. | 204/44.3 |
| 4,199,416 | 4/1980 | Middleton et al. | 204/44 |
| 4,591,415 | 5/1986 | Whitlaw | 204/15 |

*Primary Examiner*—G. L. Kaplan
*Attorney, Agent, or Firm*—Staas & Halsey

[57] ABSTRACT

An electrolytic gold plating solution including a soluble gold salt, a conductivity salt, and, in addition, a mixture of a lead compound and a complexing agent having the stability constant with lead of not less than 15 or a complex obtained from the lead compound and the complexing agent and/or an amine compound having a pyrrolidine, piperazine, piperidine, or pyridine skeleton.

10 Claims, No Drawings

ELECTROLYTIC GOLD PLATING SOLUTION

BACKGROUND OF THE INVENTION

1. Field of the Invention

The invention relates to an electrolytic gold plating solution. More particularly, the present invention relates to an electroplating solution useful for gold plating of IC packages or the like which are useful in the semiconductor industry.

2. Description of the Related Art

Since gold is very expensive, when gold plating is carried out, it is required from an economical viewpoint to minimize variations in plating thickness of the plated article and to maintain the plate thickness at or near the required level. On the other hand, from a plate quality viewpoint, broad variations in plate thickness cause problems in that wire bondability is deteriorated in areas having a relatively large plate thickness and plate thicknesses are extremely small at concave portions and through holes, resulting in deteriorated heat resistance and solderability. Accordingly, the gold plating procedures for IC packages are required to produce a plate thickness as uniform as possible from the viewpoints of the cost and quality (see, for example, Japanese Unexamined Patent Publication (Kokai) Nos. 56-84495 and 56-108892). However, since gold is deposited in a large amount at the convex or projected portions of the article where the electric current is concentrated due to the fundamental nature of the electroplating, a gold plate having a uniform thickess cannot be obtained. Thus, with the conventional electrolytic gold plating solutions, there have been obtained gold plates only having a throwing power of at most about 50% as calculated from the Field's equation.

Also, where conventional gold plating solutions are used, there can be only obtained either a gold plate having semibright and uneven surfaces and a large crystalline size, or a gold plate having bright and very smooth surfaces and a small crystalline size. This difference in appearance is due to the differences in the additives (so called grain refiners ) added to the gold plating solution for the purpose of improving the quality of the resulting gold plate. Thus, a gold plating solution containing a thallium or lead compound produces the former gold plate having semibright and uneven surfaces and a large crystalline size, while a gold plating solution containing an arsenic compound produces the latter gold plate having bright and very smooth surfaces and a small crystalline size. That is to say, where conventional gold plating solutions are used, only gold plates having one of the above-mentioned appearances can be obtained and gold plates having different appearances cannot be obtained.

SUMMARY OF THE INVENTION

It is the primary object of the present invention to provide an electrolytic gold plating solution which can produce a gold plate of relatively uniform thickness on a single plated article or on two or more different plated articles without concern for the distribution of the current density and/or of a crystalline size different from those obtained using conventional gold plating solutions.

Thus, the present invention provides an electrolytic gold plating solution comprising, in addition to a soluble gold salt and a conductivity salt, a mixture of a lead compound and a complexing agent having a stability constant with lead of not less than 15 or a complex obtained therefrom, and/or an amine compound having a pyrrolidine, piperazine, piperidine, or pyridine skeleton.

DESCRIPTION OF THE PREFERRED EMBODIMENTS

The soluble gold salts usable for the present invention include, for example, gold potassium cyanide and gold sulfite. It is preferred that the soluble gold salt be contained in the solution in an amount of not less than 2 g/l as metallic gold. As examples of the conductivity salt, there can be mentioned acids such as phosphoric, citric, pyrophosphoric, and oxalic acids and alkali metal salts, preferably potassium salts, thereof.

The complexing agents usable for the present invention include, for example, ethylenediaminetetraacetic acid (EDTA), trans-cyclohexanediaminetetraacetic acid (CyDTA), diethylenetriaminepentaacetic acid (DTPA), hydroxyethylethylenediaminetriacetic acid (EDTA-OH), glycoletherdiaminetetraacetic acid (GEDTA), triethylenetetraaminehexaacetic acid (TTHA), diaminopropanetetraacetic acid (Methyl-EDTA), ethylenediamine-di(o-hydroxyphenylacetic acid) (EDDHA), and alkali metal salts thereof. Preferably, the complexing agent is contained in the plating solutions according to the present invention in an amount of 0.0001 to 100 g/l.

As mentioned above, to the electrolytic gold plating solution according to the present invention, there may contain a mixture of a lead compound and a complexing agent as mentioned above or a lead complex formed from such lead compound and complexing agent. Preferably, the lead complex is contained in the plating solution in an amount of 0.5 to 500 ppm as metallic lead.

Where gold plating is carried out using the plating solution according to the present invention containing the above-mentioned lead complex or its precursor mixture, a gold plate having a desired crystalline size, which is different from that of a conventional gold plate, and capable of satisfying the quality required for IC packages and the like can be obtained in a broad current density range.

Examples of amine compounds having a pyrrolidine skeleton and usable for purposes of the present invention include N-aminopyrrolidine, N-aminomethylpyrrolidine, and N-aminoethylpyrrolidine. Examples of useful amine compounds having a piperazine skeleton include N-aminopiperazine, N-aminoethylpiperazine, and N,N'-diaminopiperazine. Examples of useful amine compounds having a piperidine skeleton include N-aminopiperidine, N-aminomethylpiperidine, and N-aminoethylpiperidine. Examples of useful amine compounds having a pyridine skeleton include 2-aminopyridine, 3-aminopyridine, and 4-aminopyridine. Preferably, the amine compound is contained in the plating solution according to the present invention in an amount of 0.1 to 100 g/l, and especially in an amount of 1 to 30 g/l.

Where gold plating is carried out using a plating solution according to the present invention containing the above-mentioned amine compound, good throwing power is attained.

Further, where gold plating solutions according to the present invention and containing both the above-mentioned lead complex or its precursor and the above-mentioned amine compound are used, a gold plate can be obtained which has a desired particle size different from that of a conventional gold plate, which is capable of satisfying the quality required for IC packages and the like, and which has a uniform thickness as well.

The electrolytic gold plating solution according to the present invention can be easily used for electrolytic gold plating by conventional plating methods, such as rack plating, jet plating, and barrel plating.

As mentioned hereinbefore, in conventional gold plating solutions, it is general practice to employ, as grain refiners, compounds of arsenic, thallium and lead, such as potassium arsenite, thallium sulfate and lead acetate. However, if such conventional grain refiners are employed in an electrolytic gold plating solution containing a soluble gold salt and a conductivity salt in combination with the above-mentioned amine compound, the ability of the amine compound to improve the throwing power may be deleteriously affected. Contrary to this, if the lead complex or precursor mixture of the present invention is employed as the grain refiner, in combination with the amine compound, the ability of the amine compound to improve the throwing power is not deleteriously affected and a gold plate having excellent quality can be obtained.

The present invention will now be further illustrated by the following examples.

EXAMPLE 1

A gold plating solution of the following composition was prepared:

12 g/l (8 g/l as metallic gold) of gold potassium cyanide;
50 g/l of tripotassium citrate;
50 g/l of monopotassium phosphate;
2 ppm (as metallic lead) of lead-ethylenediaminetetraacetic acid; and
water to 1 liter.

Using the above solution, electroplating was carried out on a test specimen which had been preliminarily subjected to gold strike plating. The pH of the solution was 6.0, the temperature of the solution was 60° C., the current density was 0.3 ASD, and the solution was moderately agitated. The resulting gold plate had a bright appearance of lemon yellow color shade. The crystals of the gold plate obtained were different from those obtained using a conventional plating solution having the same composition as the above solution except that lead acetate was included instead of lead-ethylenediaminetetraacetic acid. The crystals of the gold plate obtained from the above solution provided a smooth plate surface and had a size smaller than those obtained from the above-mentioned conventional plating solution.

An analysis of the gold plate resulting from plating with the above solution revealed that the same contained 0.8 ppm of codeposited lead. For comparison, the above-mentioned gold plating procedure was repeated except that 2 ppm (as metallic lead) of lead acetate was used instead of lead-ethylenediaminetetraacetic acid (the complex of lead and ethylenediaminetetraacetic acid). The amount of codeposited lead in the resulting gold plate was 24.0 ppm. Further, the amount of codeposited lead resulting in the high current density area at a current density of 0.6 ASD was 6.9 ppm in the gold plate obtained from the above-mentioned plating solution containing lead-ethylenediaminetetraacetic acid while such amount was 36 ppm in the gold plate obtained from the above-mentioned plating solution containing lead acetate.

Thus, it was proven that with the use of the gold plating solution according to the present invention, the wettability of a die in the die bonding of a semiconductor is improved since the amount of the codeposited lead in the gold plate can be minimized, and the practical current density range is widened because low levels of codeposited lead can be achieved over a broad current density range.

EXAMPLE 2

A gold plating solution of the following composition was prepared:

12 g/l of gold potassium cyanide;
50 g/l of tripotassium citrate;
50 g/l of monopotassium phosphate;
2 ppm (as metallic lead) of lead-hydroxyethylethylenediaminetriacetic acid; and
water to 1 liter.

Using this solution, gold plating was carried out under the conditions that the pH of the solution was 6.0, the temperature of the solution was 60° C., the current density was 0.3 ASD, and the solution was moderately agitated. The obtained gold plate had a semibright and fairly uneven appearance. The crystalline size of the gold plate was smaller than that obtained from a conventional gold plating solution having the same composition as the above solution except that lead acetate was utilized instead of lead-hydroxyethylethylenediaminetriacetic acid, but larger than that obtained from the plating solution of Example 1 wherein lead-ethylenediaminetetraacetic acid was used.

The amount of the codeposited lead in the gold plate was smaller than that obtained using the above-mentioned conventional plating solution containing lead acetate.

EXAMPLE 3

A gold plating solution having the following composition was prepared:

12 g/l of gold potassium cyanide;
50 g/l of tripotassium citrate;
50 g/l of monopotassium phosphate;
2 ppm (as metallic lead) of lead-trans-cyclohexanediaminetetraacetic acid; and
water to 1 liter.

Using this plating solution, gold plating was carried out under the conditions that the pH of the solution was 6.0, the temperature of the solution was 60° C., the current density was 0.3 ASD, and the solution was moderately agitated. The obtained gold plate had a bright and smooth appearance. The crystalline size of the gold plate was smaller than that obtained from the plating solution of Example 1 wherein lead-ethylenediaminetetraacetic acid was utilized but approximately equal to that obtained from a conventional plating solution having the same composition as the above-mentioned solution except that an arsenic compound was utilized instead of lead-trans-cyclohexanediaminetetra-acetic acid.

The amount of the codeposited lead in the gold plate was smaller than that obtained using a conventional plating solution having the same composition as the above-mentioned solution except that lead acetate was included instead of lead-trans-cyclohexanediaminetetraacetic acid.

EXAMPLE 4

A gold plating solution having the following composition was prepared:

12 g/l (8 g/l as metallic gold) of gold potassium cyanide;
25 g/l of citric acid;
75 g/l of dipotassium hydrogenphosphate;
10 ml/l of N-aminopyrrolidine;
2 ppm (as arsenic) of potassium arsenite; and water to 1 liter. p Using this plating solution, Hull cell plating was carried out at a pH of 6.0, a temperature of 60° C., and a current density of 0.3 ASD for 5 minutes, under moderate agitation. A bright gold plate of lemon yellow color shade was obtained. The gold plate had fully satisfactory properties, such as adhesive properties and heat resistance, as required for plating IC packages. The thickness of the obtained Hull cell panel was measured at 4 points using a fluorescent X-ray micro-portion film thickness gauge and the throwing power was calculated from the Field equation. The throwing power was 92%.

Measurement of a gold plate obtained from a gold plating solution having the same composition as the above-mentioned solution except that N-aminopyrrolidine was not included revealed a throwing power of 42%.

EXAMPLE 5

Using a gold plating solution of the following composition, Hull cell plating was carried out under the same condition as in Example 4:

12 g/l (8 g/l as metallic gold) of gold potassium cyanide;
25 g/l of citric acid;
75 g/l of dipotassium hydrogenphosphate;
1 ml/l of N-aminoethylpiperazine;
10 ppm (as thallium) of thallous sulfate; and
water to 1 liter.

A semibright gold plate of lemon yellow color shade was obtained. The gold plate had fully satisfactory properties, such as adhesive properties and heat resistance, as required for plating IC packages. The throwing power of the plate as measured as in Example 4 was 74%.

The throwing power measured for a gold plate obtained from a plating solution having the same composition as the above-mentioned plating solution except that N-aminoethylpiperazine was not included was 33%.

EXAMPLE 6

Hull cell plating was carried out under the same conditions as in Example 4 using a gold plating solution of the following composition:

12 g/l (8 g/l as metallic gold) of gold potassium cyanide;
50 g/l of tripotassium citrate;
50 g/l of monopotassium phosphate;
20 g/l of 4-aminopyridine;
5 ppm (as lead) of lead acetate; and
water to 1 liter.

A semibright gold plate of lemon yellow color shade was obtained. The gold plate had fully satisfactory properties, such as adhesive properties and heat resistance, as required for plating IC packages. The throwing power of the plate as measured as in Example 4 was 69%.

Measurement of gold plate obtained from a plating solution having the same composition as above-mentioned solution except that 4-aminopyridine was not included revealed a throwing power of 27%.

EXAMPLE 7

A gold plating solution having the following composition was prepared:

8 g/l (as metallic gold) of gold potassium cyanide;
50 g/l of tripotassium citrate;
50 g/l of monopotassium phosphate;
2 ppm (as lead) of lead-ethylenediaminetetraacetic acid;
20 ml/l of N-aminopyrrolidine; and
water to 1 liter.

Using this plating solution, Hull cell plating was carried out at a pH of 6.0, temperature of 60° C., and currently density of 0.3 ASD for 5 minutes while moderately agitating. A bright and smooth gold plate of lemon yellow color shade and having a small crystalline size was obtained. The appearance of the gold plate was completely different from that obtained from a conventional gold plating solution containing a compound of thallium, lead, or arsenic.

The thickness of the obtained Hull cell panel was measured at 4 points using a fluorescent X-ray micro-portion film thickness gauge and the throwing power was calculated from the Field equation. The throwing power was 97%.

Further, using the above-mentioned gold plating solution, IC packages (16 pin dual in-line package) were gold plated and the variation in thickness of the gold plate at the center portions of the stages of the IC packages within one rack (32 packages/rack) was determined. The gold plating was carried out at a temperature of 60° C. and current density of 0.2 ASD while weakly agitating so as to obtain a gold plate of a thickness of 2 μm. The obtained gold plate had an average thickness of 1.94 μm with a standard deviation of 0.08. This proved that IC packages could be gold plated, within one rack, with a uniform thickness as desired.

For comparison, the above-mentioned procedure was repeated using a conventional plating solution as mentioned above. In the obtained gold plate, the average thickness was 1.84 μm and the standard deviation was 0.14.

These results show that gold plating solutions according to the present invention make it possible to obtain a gold plate on IC packages having a uniformity of thickness which could not have been attained using conventional gold plating solutions.

EXAMPLE 8

A gold plating solution having the following composition was prepared:

8 g/l (as metallic gold) of gold potassium cyanide;
40 g/l of monopotassium phosphate;
60 g/l of dipotassium phosphate;
2 ppm (as lead) of lead-glycoletherdiaminetetraacetic acid;
20 g/l of aminopyridine; and
water to 1 liter.

Using this plating solution, the procedure as in Example 7 was repeated except that the pH of the solution was 7.0. The obtained Hull cell panel had a semibright and even gold plate of lemon yellow color shade. Similarly to the gold plate obtained in Example 7, the gold plate obtained in this Example had an appearance completely different from that obtained using a conventional gold plating solution containing a compound of thallium, lead, or arsenic. Further, the gold plate obtained exhibited a very good throwing power of 99%.

EXAMPLE 9

The procedure of Example 7 was repeated using a gold plating solution having the following composition:

8 g/l (as metallic gold) of gold potassium cyanide;
20 g/l of monopotassium citrate;
80 g/l of tripotassium citrate;
2 ppm (as lead) of lead-trans-cycrohexanediaminetetraacetic acid;
1 ml/l of N-aminoethylpiperazine; and
water to 1 liter.

The obtained Hull cell panel had a very smooth gold plate of reddish yellow color shade. The gold plate had an appearance completely different from that obtained using a conventional gold plating solution containing a compound of thallium, lead, or arsenic. Further, the gold plate exhibited a good throwing power of 93%.

We claim:

1. An electrolytic gold plating solution comprising a soluble gold salt, a conductivity salt, a grain refining quanity of a lead component selected from the group consisting of (1) a mixture of a lead compound and a complexing agent having a stability constant with lead of not less than 15 and (2) a complex formed from said lead compound and said complexing agent, and an amine compound having a pyrrolidine, piperazine, piperidine, or pyridine skeleton.

2. An electrolytic gold plating solution as set forth in claim 1, wherein the soluble gold salt is selected from gold potassium cyanide and gold sulfite.

3. An electrolytic gold plating solution as set forth in claim 2, wherein the soluble gold salt is contained in an amount of not less than 2 g/l as metallic gold.

4. An electrolytic gold plating solution as set forth in claim 1, wherein the conductivity salt is selected from phosphoric, citric, pyrophosphoric, and oxalic acids and alkali metal salts thereof.

5. An electrolytic gold plating solution as set forth in claim 1, wherein the complexing agent is an agent selected from the group consisting of ethylenediaminetetraacetic acid, trans-cyclohexanediaminetetraacetic acid, diethylenetriaminepentaacetic acid, hydroxyethylethylenediaminetriacetic acid, glycoletherdiaminetetraacetic acid, triethylenetetraaminehexaacetic acid, diaminopropanetetraacetic acid, ethylenediamine-di(o-hydroxyphenylacetic acid) and the alkali metal salts of such acids.

6. An electrolytic gold plating solution as set forth in claim 5, wherein the complexing agent is contained in an amount of 0.0001 to 100 g/l.

7. An electrolytic gold plating solution as set forth in claim 1, wherein the lead complex is contained in an amount of 0.5 to 500 ppm as metallic lead.

8. An electrolytic gold plating solution as set forth in claim 1, wherein the amine compound is a compound selected from the group consisting of N-aminopyrrolidine, N-aminomethylpyrrolidine, N-aminoethylpyrrolidine, N-aminopiperazine, N-aminoethylpiperazine, N,N'-diaminopiperazine, N-aminopiperidine, N-aminomethylpiperidine, N-aminoethylpiperidine, 2-aminopyridine, 3-aminopyridine, and 4-aminopyridine.

9. An electrolytic gold plating solution as set forth in claim 8, wherein the amine compound is contained in an amount of 0.1 to 100 g/l.

10. An electrolytic gold plating solution as set forth in claim 9, wherein the amount of the amine compound is 1 to 30 g/l.

* * * * *

UNITED STATES PATENT AND TRADEMARK OFFICE

CERTIFICATE OF CORRECTION

PATENT NO. : 4,717,459

DATED : January 5, 1988

INVENTOR(S) : Masao Nakazawa, Yoshirou Nishiyama, Shinichi Wakabayashi

It is certified that error appears in the above-identified patent and that said Letters Patent is hereby corrected as shown below:

Column 5, line 11, delete "p" and start a new paragraph with "Using".

Signed and Sealed this

Tenth Day of May, 1988

*Attest:*

*Attesting Officer*

DONALD J. QUIGG

*Commissioner of Patents and Trademarks*